US008142302B2

(12) United States Patent
Balardeta et al.

(10) Patent No.: US 8,142,302 B2
(45) **Date of Patent: *Mar. 27, 2012**

(54) METHOD AND SYSTEM FOR SHOT TRACKING

(75) Inventors: Joseph Balardeta, Encinitas, CA (US); Scott Denton, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 10 days.

This patent is subject to a terminal disclaimer.

(21) Appl. No.: 12/837,136

(22) Filed: Jul. 15, 2010

(65) Prior Publication Data

US 2011/0028231 A1 Feb. 3, 2011

Related U.S. Application Data

(60) Provisional application No. 61/229,831, filed on Jul. 30, 2009.

(51) Int. Cl.
*A63B 69/36* (2006.01)

(52) U.S. Cl. ..... 473/222; 473/223; 473/409

(58) Field of Classification Search ..... 473/219, 473/221, 222, 223, 226, 409
See application file for complete search history.

(56) References Cited

U.S. PATENT DOCUMENTS

| | | | | |
|---|---|---|---|---|
| 6,224,493 | B1 | 5/2001 | Lee et al. | |
| 6,402,634 | B2 | 6/2002 | Lee et al. | |
| 6,431,990 | B1 | 8/2002 | Manwaring | |
| 6,638,175 | B2 | 10/2003 | Lee et al. | |
| 6,821,209 | B2 | 11/2004 | Manwaring et al. | |
| 7,163,468 | B2 | 1/2007 | Gibbs et al. | |
| 7,163,470 | B2 | 1/2007 | Galloway et al. | |
| 7,166,038 | B2 | 1/2007 | Williams et al. | |
| 7,214,143 | B2 | 5/2007 | Deshmukh | |
| 7,252,600 | B2 | 8/2007 | Murphy et al. | |
| 7,258,626 | B2 | 8/2007 | Gibbs et al. | |
| 7,258,631 | B2 | 8/2007 | Galloway et al. | |
| 7,273,419 | B2 | 9/2007 | Evans et al. | |
| 7,413,250 | B2 | 8/2008 | Connolly et al. | |
| 7,883,428 | B1 * | 2/2011 | Balardeta et al. | 473/222 |
| 2009/0075761 | A1 | 3/2009 | Balardeta et al. | |
| 2010/0060428 | A1 * | 3/2010 | Lee et al. | 340/10.1 |
| 2010/0144456 | A1 * | 6/2010 | Ahern | 473/222 |
| 2011/0028230 | A1 * | 2/2011 | Balardeta et al. | 473/222 |

* cited by examiner

*Primary Examiner* — Nini Legesse
(74) *Attorney, Agent, or Firm* — Michael A. Catania; Rebecca Hanovice; Sonia Lari

(57) ABSTRACT

A system and method for shot tracking disclosed herein. The system preferably includes a golf club and a receiver. The golf club preferably includes an active RFID transponder, a power source, a switch and an accelerometer.

13 Claims, 8 Drawing Sheets

METHOD AND SYSTEM FOR SHOT TRACKING

CROSS REFERENCES TO RELATED APPLICATIONS

The Present Application claims priority upon U.S. Provisional Application No. 61/22983, filed Jul. 30, 2009.

STATEMENT REGARDING FEDERALLY SPONSORED RESEARCH OR DEVELOPMENT

Not Applicable

BACKGROUND OF THE INVENTION

1. Field of the Invention

The present invention relates to shot tracking. More specifically, the present invention relates to a method and system for tracking shots of a golfer during a round of golf.

2. Description of the Related Art

Golf clubs combine with the players swing to propel a ball toward a favored location and through a favored path. The orientation and speed of the club head at impact largely determines the ball path including carry distance and roll.

The prior art is lacking in a method and system to measure the motion of the club through measurement of the shaft.

BRIEF SUMMARY OF THE INVENTION

The present invention is novel in that the observation of the relative motion does not depend on near visible light and uses a coherent pattern to capture the position of the club relative the ground antenna transmitter/receiver. This fixed device also includes a display, computing capability and recording device. This information, when processed, enables the display of the swing and uses data on the club head and ball to calculate the flight of the ball.

This invention is a club shaft that can be installed in a club head permanently or can be installed in clubs with interchangeable shaft features. The invention is the measurement device that enables the capturing of the speed and motion of the swing. The invention uses two antennas, one transmitting and one receiving. The power of the radar wave is low. The wavelength will be on the order of a millimeter. The antennas' shapes are designed to improve the accuracy of measurement of location as a function of time. One antenna is designed to conform to the shaft or reside in the shaft. Material substitutions in the shaft can be utilized to improve the antenna function. In the first embodiment, the antenna in the shaft shall be attached to a power source, battery and a simple electronic circuit. The second antenna, the transmitting/receiver, will reside off the club and will receive the transmissions of the shaft antenna. The second embodiment will have a shaft antenna that does not rely on a battery, but reflects an electromagnetic field back to the transmitting/receiving antenna. In either case, the interactions of characteristic three dimensional amplitude variations in the antennas, their patterns, allow the measurement of relative positions over time.

The invention enables the accurate measurement and capture of the swing, produces a display of the impact and ball flight and thus improves the training and practice results for the golfer.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
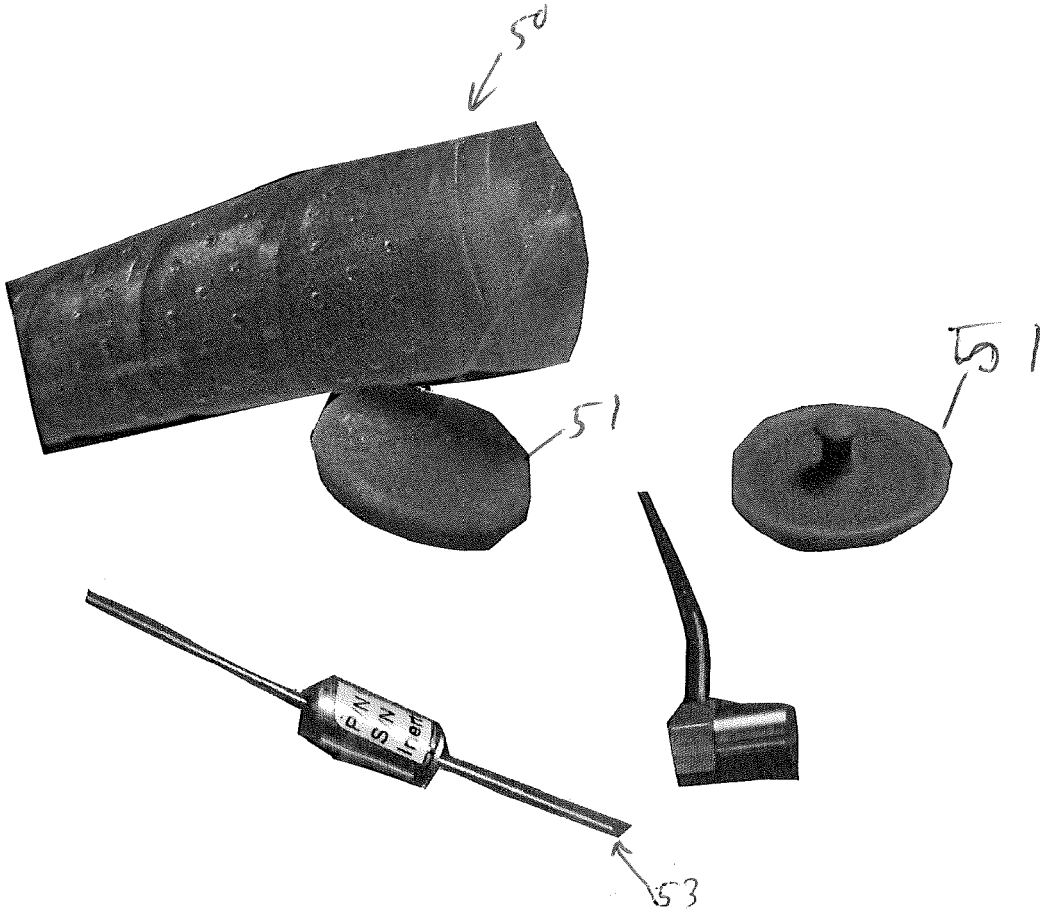
FIG. 1 is a perspective view of components of a system for shot tracking.

As shown in FIG. 1, components of the system can be attached to a golf club. Alternatively, the components can be integrated into a golf club.

Figure 2:
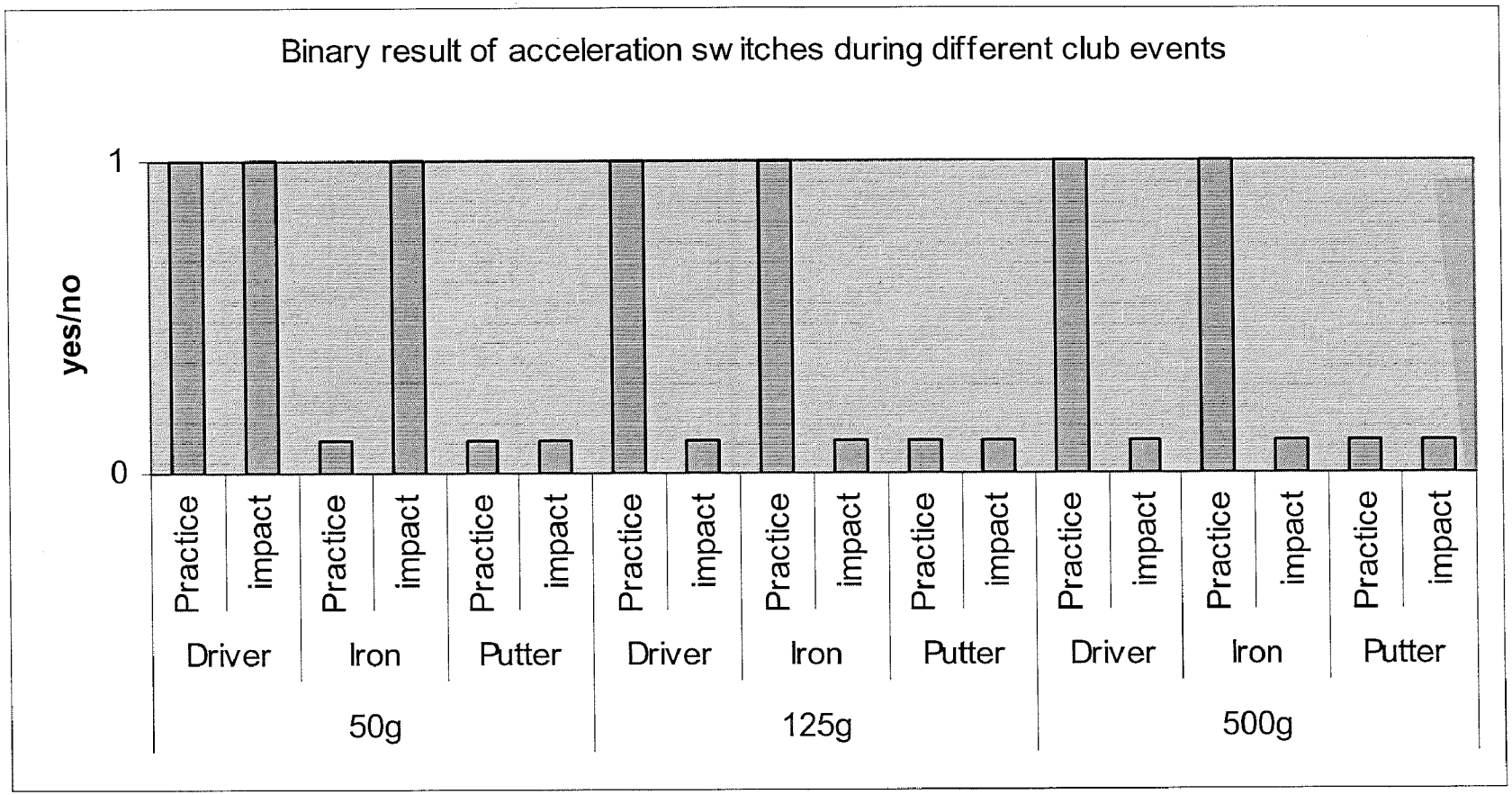
FIG. 2 is a graph of a binary result of acceleration switches during different club events.

FIG. 2 shows that different levels of acceleration switches can be effectively used to detect that a golf club has been used during by a golfer. A 50 g switch, a 125 g switch and a 500 g switch were used for this testing.

Figure 3:
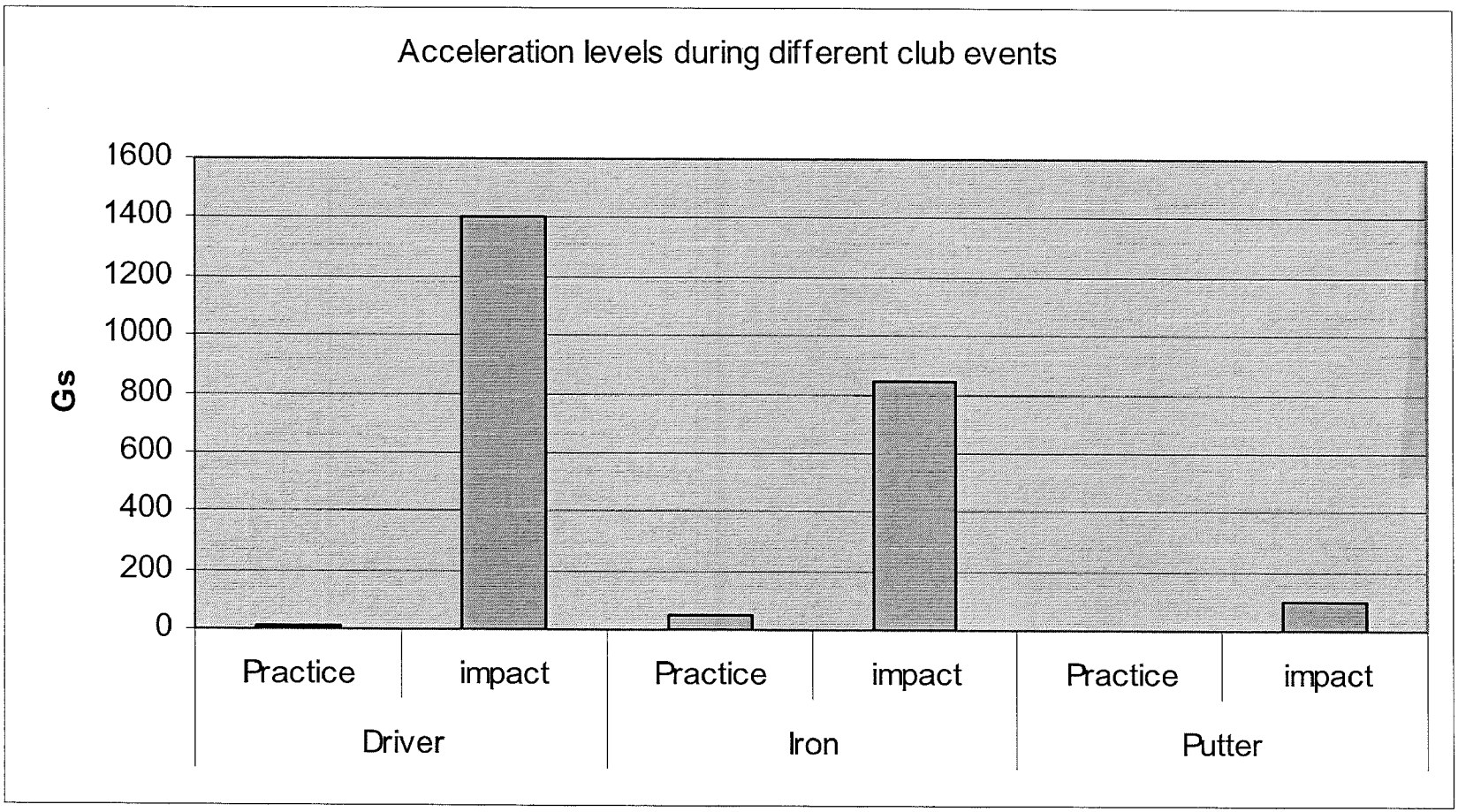
FIG. 3 is a graph of acceleration levels during different club events.

FIG. 3 shows the levels detected during a golf club impact with a golf ball.

Figure 4:
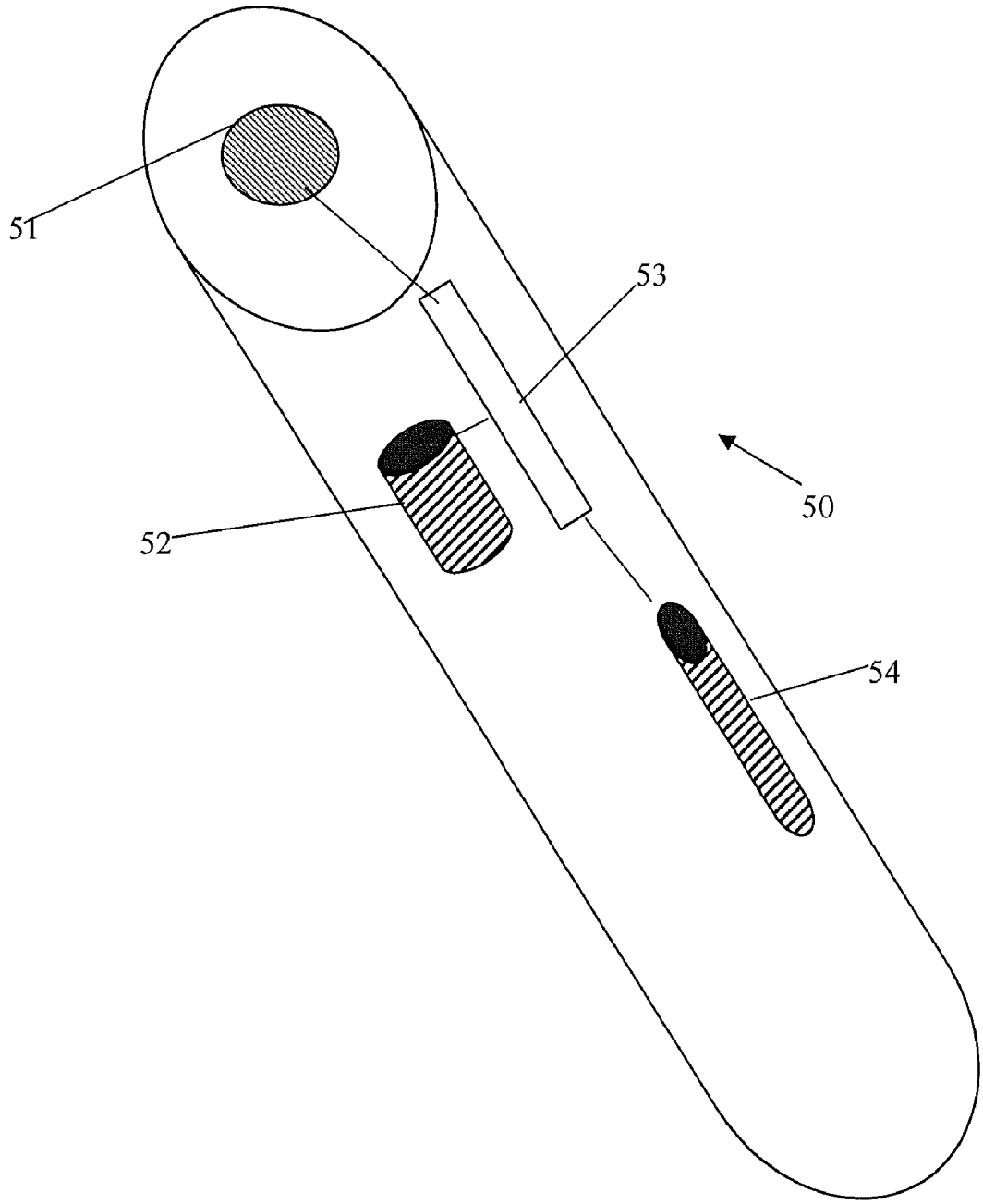
FIG. 4 is an illustration of a portion of a golf club illustrating the components.

FIG. 4 illustrates a portion of a golf club 50. The components of the system 20 within the golf club 50 preferably include an active RFID transponder 51, a power source 52, a switch 53 and an accelerometer 54. Those skilled in the pertinent art will recognize that the accelerometer and switch may be a single device.

Figure 5:
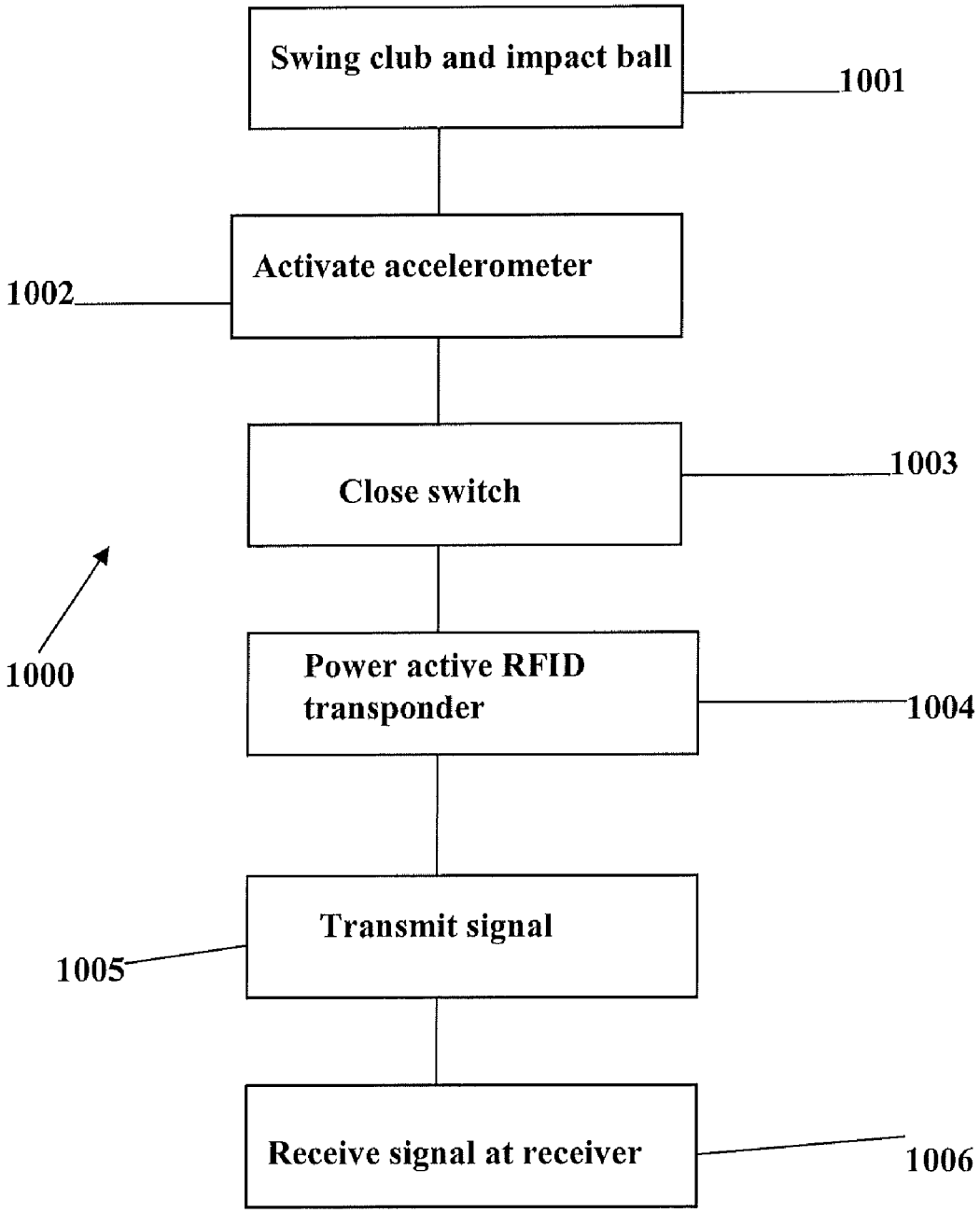
FIG. 5 is a flow chart of a method of shot tracking.

FIG. 5 is a flow chart of a method 1000 for shot tracking. At block 1001, a golfer swings a club and impacts a golf ball. At block 1002, an accelerometer is activated by the impact of the golf club with the golf ball. At block 1003, a switch located between a power source and an active RFID transponder is temporarily closed due to the activation of the accelerometer. At block 1004, the active RFID transponder is powered by the power source. At block 1005, the active RFID transponder transmits at least one signal containing data about the golf club. At block 1006, the signal is received at a receiver.

Figure 6:
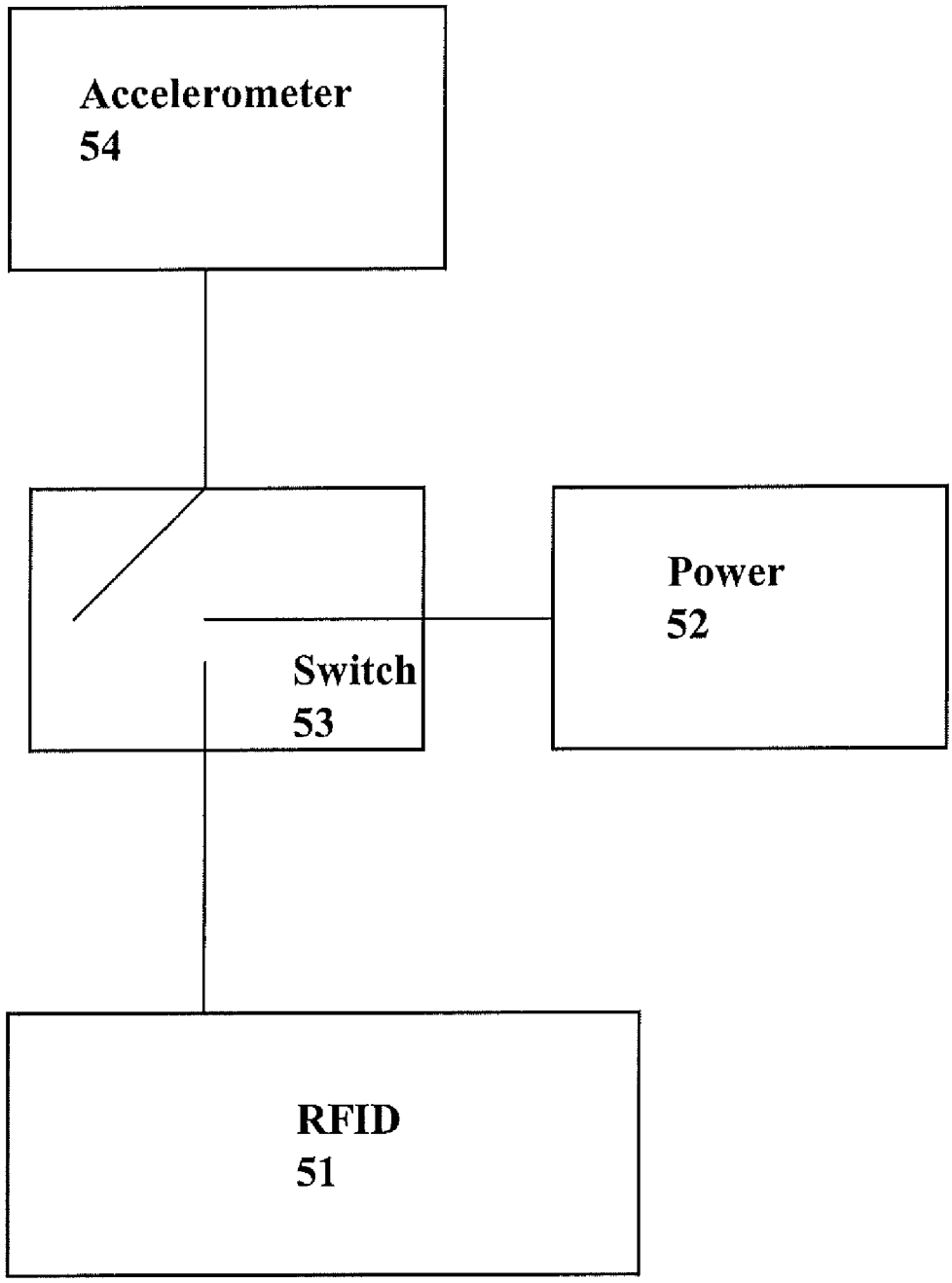
FIG. 6 is a block diagram of components of a system for shot tracking with the switch open.

FIG. 6 illustrates components of the system located within a golf club prior to impact of a golf club with a golf ball.

Figure 7:
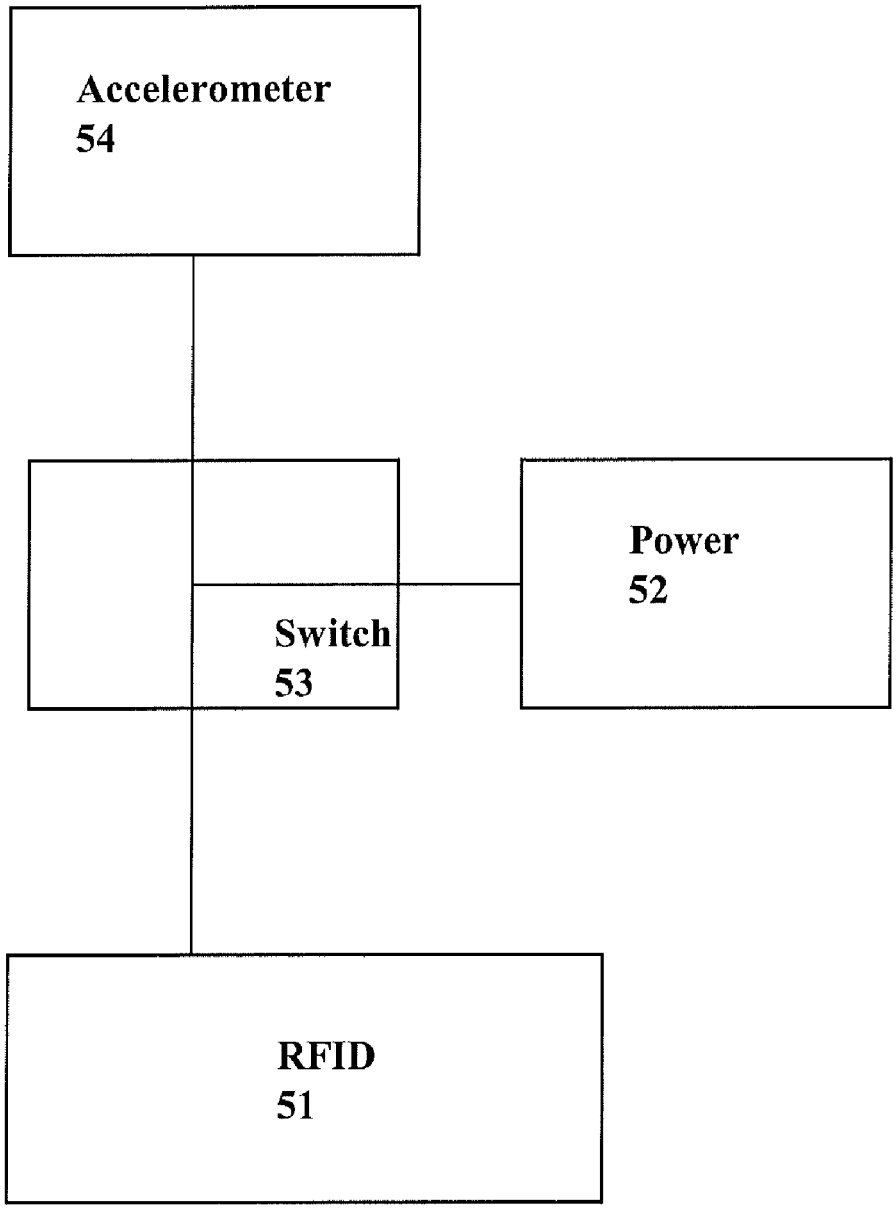
FIG. 7 is a block diagram of components of a system for shot tracking with the switch closed.

FIG. 7 illustrates components of the system located within a golf club subsequent to impact of a golf club with a golf ball.

Figure 8:
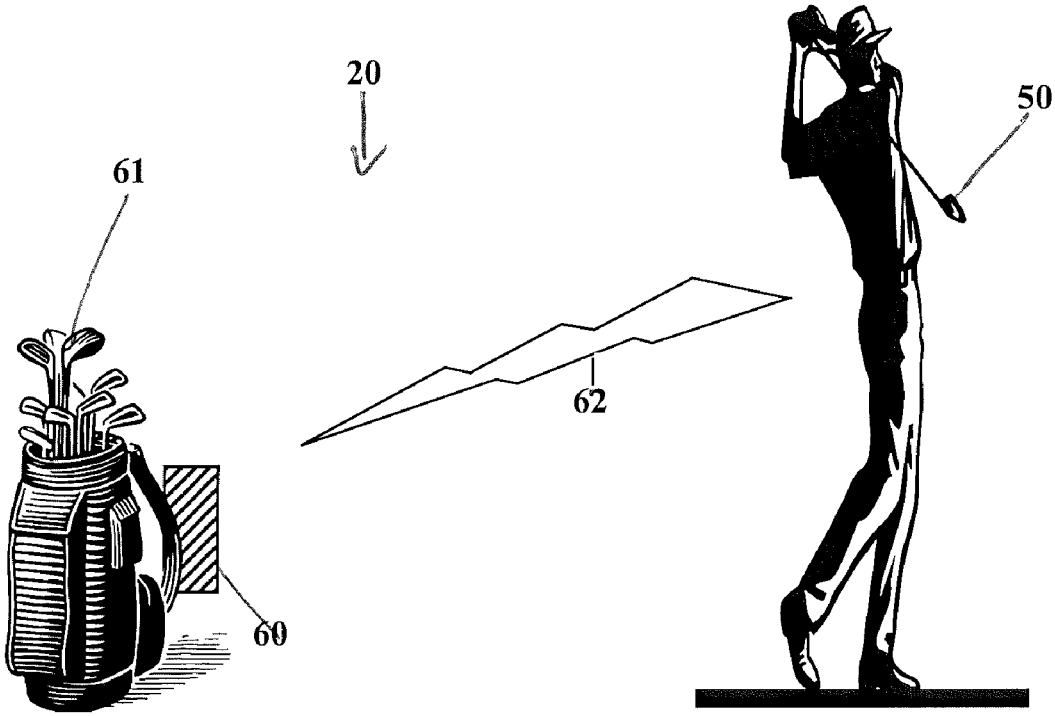
FIG. 8 is an illustration of a system for shot tracking.

FIG. 8 illustrates the system 20. A transponder in a golf club 50 swung by a golfer sends a signal 62 to a receiver 60. The receiver is attached to a golf bag 61, however, those skilled within the pertinent art will recognize that the receiver may be attached to any pertinent device including the golfer, or may stand alone.

The receiver is preferably a GPS device such as disclosed in Balardeta et al., U.S. Patent Publication Number 20090075761 for a Golf GPS Device And System, which is hereby incorporated by reference in its entirety. Alternatively, the receiver is a personal digital assistant (PDA), "smart phone", mobile phone, or other similar device. However, those skilled in the pertinent art will recognize that the receiver may be any device capable of receiving and storing signals from the RFID tag.

Gibbs, et al., U.S. Pat. No. 7,163,468 is hereby incorporated by reference in its entirety.

Galloway, et al., U.S. Pat. No. 7,163,470 is hereby incorporated by reference in its entirety.

Williams, et al., U.S. Pat. No. 7,166,038 is hereby incorporated by reference in its entirety.

Desmukh U.S. Pat. No. 7,214,143 is hereby incorporated by reference in its entirety.

Murphy, et al., U.S. Pat. No. 7,252,600 is hereby incorporated by reference in its entirety.

Gibbs, et al., U.S. Pat. No. 7,258,626 is hereby incorporated by reference in its entirety.

Galloway, et al., U.S. Pat. No. 7,258,631 is hereby incorporated by reference in its entirety.

Evans, et al., U.S. Pat. No. 7,273,419 is hereby incorporated by reference in its entirety.

Hocknell, et al., U.S. Pat. No. 7,413,250 is hereby incorporated by reference in its entirety.

The measurements may be inputted into an impact code such as the rigid body code disclosed in U.S. Pat. No. 6,821,209, entitled Method for Predicting a Golfer's Ball Striking Performance, which is hereby incorporated by reference in its entirety.

The swing properties are preferably determined using an acquisition system such as disclosed in U.S. Pat. No. 6,431,990, entitled System and Method for Measuring a Golfer's Ball Striking Parameters, assigned to Callaway Golf Company, the assignee of the present application, and hereby incorporated by reference in its entirety. However, those skilled in the pertinent art will recognize that other acquisition systems may be used to determine the swing properties.

Other methods that are useful in obtaining a golfer's swing characteristics are disclosed in U.S. Pat. No. 6,638,175, for a Diagnostic Golf Club System, U.S. Pat. No. 6,402,634, for an Instrumented Golf Club System And Method Of Use, and U.S. Pat. No. 6,224,493, for an Instrumented Golf Club System And Method Of Use, all of which are assigned to Callaway Golf Company, the assignee of the present application, and all of which are hereby incorporated by reference in their entireties.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A system for automatically tracking a golf club swung by a golfer, the system comprising:

a golf club comprising a shaft and a golf club head, the golf club having a an accelerometer in electrical communication with an active RFID transponder, the accelerometer temporarily closing a switch during impact with a golf ball to provide power from a power source to the RFID transponder for transmission of a signal, the signal containing data for the specific golf club, wherein the accelerometer, the active RFID transponder, the switch and the power source are located within the shaft of the golf club;

a receiver for receiving the signal from the RFID transponder, the receiver having a second antenna;

wherein the system captures a swing speed and swing motion of the golf club swung by golfer and wherein the interactions of characteristic three dimensional amplitude variations in the antennas allow for the measurement of relative positions of the golf club over the time of the swing.

2. The system according to claim 1 wherein the receiver is a GPS unit.

3. The system according to claim 1 wherein the receiver stores data for each shot by the golfer for a round of golf.

4. The system according to claim 1 wherein the data of the signal comprises type of club and force of the shot.

5. The system according to claim 1 wherein the type of club is selected from wedge, 9-iron, 8-iron, 7-iron, 6-iron, 5-iron, 4-iron, 3-iron, 2-iron, 9-wood, 7-wood, 5-wood, 3-wood, driver, putter, 1-hybird, 2-hybrid, 3-hybrid, 4-hybrid, 5-hybrid and 6-hybrid.

6. The system according to claim 1 wherein the accelerometer is a 50 G accelerometer.

7. A method for shot tracking, the method comprising:

impacting a golf ball with a golf club;

activating an accelerometer positioned within a shaft of the golf club;

closing a switch for a set time period, the switch positioned between a power source and an active RFID transponder within the shaft of the golf club;

powering the active RFID transponder with power from the power source;

transmitting a signal from the active RFID transponder, the signal comprising golf club data for a swing speed and swing motion for the golf club swung by the golfer; and receiving the signal at a receiver, the receiver having a second antenna;

wherein the interactions of characteristic three dimensional amplitude variations in the antennas allow for the measurement of relative positions of the golf club over the time of the swing.

8. The method according to claim 7 wherein the receiver is a GPS unit.

9. The method according to claim 7 wherein the receiver stores data for each shot by the golfer for a round of golf.

10. The method according to claim 7 wherein the data of the signal comprises type of club and force of the shot.

11. The method according to claim 7 wherein the type of club is selected from wedge, 9-iron, 8-iron, 7-iron, 6-iron, 5-iron, 4-iron, 3-iron, 2-iron, 9-wood, 7-wood, 5-wood, 3-wood, driver, putter, 1-hybird, 2-hybrid, 3-hybrid, 4-hybrid, 5-hybrid and 6-hybrid.

12. The method according to claim 7 wherein the accelerometer is a 500 G accelerometer.

13. The method according to claim 7 further comprising storing the data at the receiver.

* * * * *